United States Patent [19]

Ide

[11] Patent Number: 4,619,514

[45] Date of Patent: Oct. 28, 1986

[54] MONOCHROMATIC PHOTOCOPYING APPARATUS AND METHOD INCLUDING COLOR SELECTION

[75] Inventor: Fumitō Ide, Zama, Japan

[73] Assignee: Kabushiki Kaisha Toshiba, Kawasaki, Japan

[21] Appl. No.: 661,191

[22] Filed: Oct. 15, 1984

[30] Foreign Application Priority Data

Oct. 18, 1983 [JP] Japan ..... 58-195030

[51] Int. Cl.[4] ..... G03G 15/08

[52] U.S. Cl. ..... 355/3 R; 355/3 DD; 355/14 D; 355/14 R; 355/4; 118/688; 118/645; 430/42; 430/120

[58] Field of Search ..... 355/4, 14 R, 3 R, 10, 355/3 DD, 14 D; 118/712, 645, 688, 689, 690; 430/30, 43, 42, 356, 357, 120

[56] References Cited

U.S. PATENT DOCUMENTS

| | | | |
|---|---|---|---|
| 4,165,165 | 8/1979 | Iwami et al. | 355/14 R X |
| 4,189,224 | 2/1980 | Sakai | 335/10 X |
| 4,204,728 | 5/1980 | Goshima et al. | 355/14 R X |

FOREIGN PATENT DOCUMENTS

| | | |
|---|---|---|
| 2705846 | 2/1977 | Fed. Rep. of Germany . |
| 3102960 | 1/1981 | Fed. Rep. of Germany . |
| 3247871 | 12/1982 | Fed. Rep. of Germany . |

*Primary Examiner*—A. C. Prescott

*Attorney, Agent, or Firm*—Cushman, Darby & Cushman

[57] ABSTRACT

A copying machine employs a plurality of color developers. Monochromatic copy is reproduced by selecting one of the color developers, where one-colored toner particles are contained. The copying machine also comprises a color selection switch and an LCD display panel for displaying pictorial diagrams. The color selection for each color developer can be visually recognized by the pictorial diagram.

10 Claims, 24 Drawing Figures

WAITING MODE.

BLACK COPY REPRODUCTION

RED COPY REPRODUCTION

DEPLETION OF BLACK TONER

DEPLETION OF RED TONER

MONOCHROMATIC PHOTOCOPYING APPARATUS AND METHOD INCLUDING COLOR SELECTION

BACKGROUND OF THE INVENTION

The invention relates to an image forming apparatus and method in which a plurality of colour developers are selectively actuated to produce monochromatic copies, e.g., red copies from an original document.

Among the conventional image forming apparatus such as an electrostatic copying machine, monochromatic copies, e.g., red, blue, or black copies can be produced. In this copying machine, a colour is selected by replacing one colour developer by another colour developer.

An object of the present invention is to visually recognize such a colour selection in the image forming apparatus where a plurality of monochromatic developers are employed, one of the monochromatic developers being exclusively operated during a one-copy production cycle.

Another object of the present invention is to visually recognize whether the monochromatic toner is depleted.

SUMMARY OF THE INVENTION

The object of the present invention may be accomplished by providing an image forming apparatus comprising:

a colour selector for exclusively selecting a plurality of colour modes on the monochromatic copies;

a reproduction device for reproducing the monochromatic copies in accordance with one colour mode selected by the colour selector; and a display device for displaying the selected colour mode, whereby the colour of the monochromatic copies to be reproduced can be visually recognized.

BRIEF DESCRIPTION OF THE DRAWINGS

The invention is best understood by reference to the accompanying drawings, in which.

DETAILED DESCRIPTION OF THE PREFERRED EMBODIMENTS

A detailed description of the invention, as given in this specification, is organized in accordance with the following index which is presented for the convenience of the reader.

I. GENERAL DESCRIPTION OF MONOCHROMATIC COPY REPRODUCTION APPARATUS

II. DETAILED DESCRIPTION OF THE REPRODUCTION APPARATUS a. OPERATION PANEL b. DISPLAY SECTION c. SYSTEM CONTROL CIRCUIT DIAGRAM d. DRIVE CIRCUIT FOR LCD PANEL e. SELECTED MODE OF OPERATION WAITING f. READY FOR COPYING BLACK COPIES g. READY FOR COPYING RED COPIES h. DEPLETION OF BLACK TONER PARTICLES i. DEPLETION OF RED TONER PARTICLES j. COLOUR SELECTION k. TONER DEPLETION l. MULTI-COLOURED COPY REPRODUCTION

GENERAL DESCRIPTION FOR MONOCHROMATIC COPY REPRODUCTION APPARATUS

Before proceeding with detailed embodiments, typical operations of an electrostatic copying machine according to the invention will now be summarized.

Figure 1:
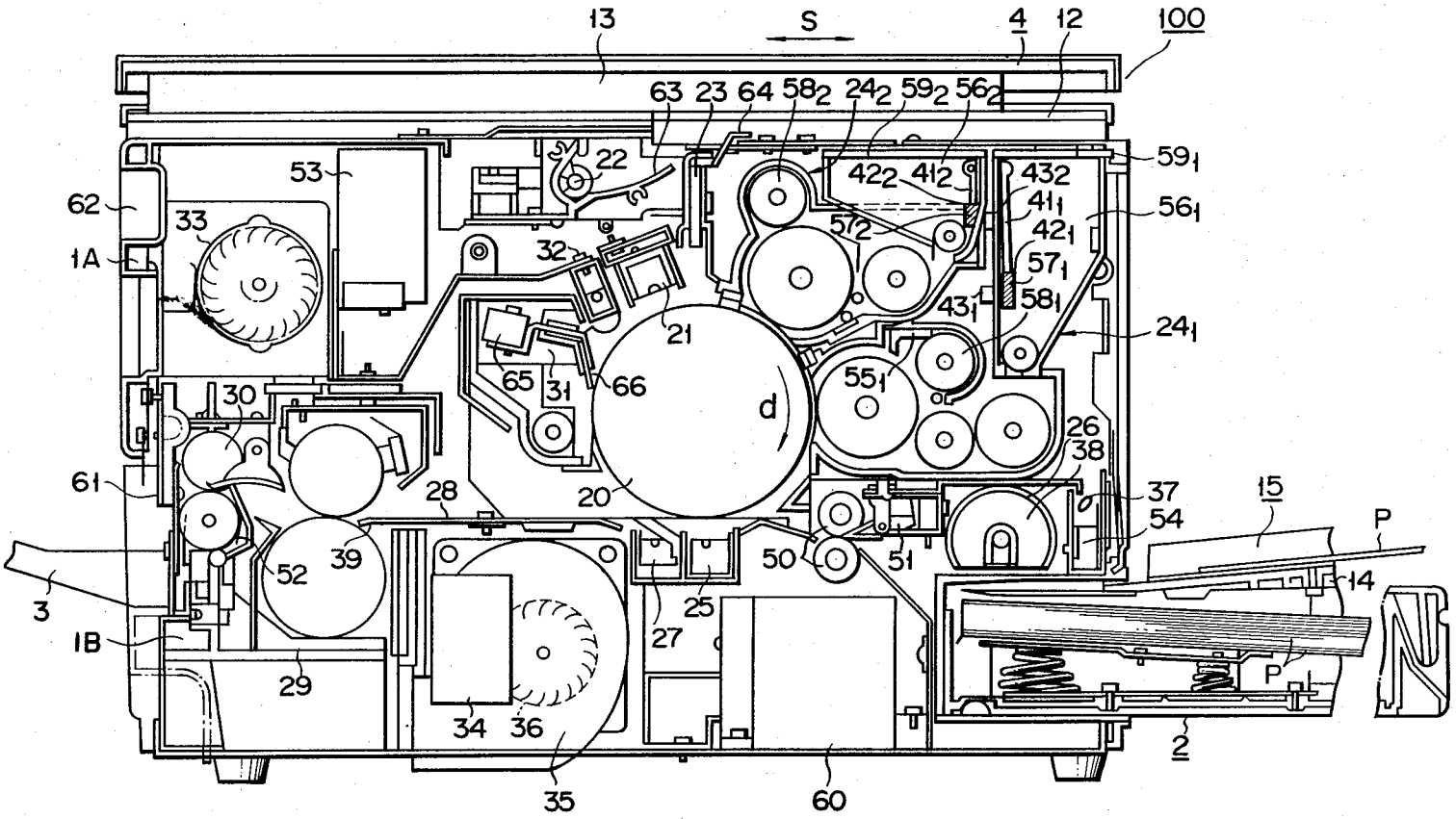
FIG. 1 shows a side view of a copying machine according to one preferred embodiment of the present invention.

Referring to FIG. 1, the electrostatic copying machine 100 is shown. The copying machine 100 is comprised of the following major functioning sections. Reference numeral 1 denotes a housing of the copying machine 100. A paper supply cassette 2 is detachably mounted on the right lower end portion of the machine 100, as viewed in the drawing. A copy delivery tray 3 is mounted on the left lower end portion of the machine 100, viewed in the drawings. A document supporter 4 is slidably mounded on the upper portion of the copying machine 100. A slide direction is indicated by "S". An operation panel (not shown in detail) is provided at the front end portion of the upper surface of the copying machine 100.

The document supporter 40 is constructed by a platen glass 12 and a platen cover 13. A cassette cover 14 of the paper supply cassette 2 functions as a hand feed-in type paper supply tray 15, by which a sheet of paper P can be smoothly fed into the copying machine 100.

A photosensitive drum 20 (referred to as "a drum") is located substantially in the center of the copying machine 100. The drum 20 is driven by a drive mechanism (not shown) in a direction denoted by an arrow "d" in synchronism with the slide action of the document supporter 4.

The copy production system will now be described.

A uniform electrostatic charge is formed across the drum 20 by a charger 21 while maintaining the photosensitive surface thereof in a dark condition. A latent image of an original document (not shown) is formed by illuminating the original document, transferring the optical image of the document through a lens array 23, and exposing the optical image to the photosensitive surface of the drum 20. The latent image is then developed by a monochromatic developer, e.g., a black developer $24_1$ or a red developer $24_2$ to form a toner image (visible image) on the drum 20. It is understood that the red developer $24_2$ is a developer containing red toner particles which develop the electrostatic latent image, resulting in a red-coloured toner image. The colour selection is performed by energizing a developer selector (not shown). The drum 20 on which one-coloured toner image has been formed is rotated to a transfer charger 25. As a sheet of transport material, such as plain paper "P" has previously been supplied from the paper supply cassette 2 to the transfer section, the developed toner image can be transferred from the photosensitive surface of the drum 20 to the paper P by means of the transfer charger 25. The paper sheet P on which the toner image has been transferred is left from the drum 20 by means of a separating charger 27, and is thereafter transported along a conveying path 28 to a fixing device 29. A charge of the separating charger 27 is generated by way of the AC corona discharging. The toner image transferred to the paper sheet P is fixed thereon by fusing the toner particles. Finally, the paper sheet P processed in the fixing device 29 is delivered from the detachable tray 3 by means of a delivery roller 30.

On the other hand, the toner image remaining on the drum 20 after passing through the transfer section is cleaned by a cleaning device 31. The potential of the photosensitive surface of the drum 20 is lower than the given potential by means of a discharge lamp 32, whereby the succeeding copy cycle can be prepared.

A cooling fan 33 is provided within the housing 1 to exhaust the heat of the exposure lamp 22 and the fixing device 29.

Although an upper frame and a lower frame are not shown in the drawing, one end of each frame is pivotally journalled to a supporter 37 and the other end thereof can be opened at, for instance, 30 degrees with respect to the housing 1. On the upper frame, the above-described charger 21, the lens array 23, the exposure lamp 22, the black and red developers $24_1$, $24_2$, the cleaning device 31, and the discharge lamp 32 are mounted around the photosensitive drum 20. Also the cooling fan 33, the paper supply roller 38 of the paper supply device 26, and the document supporter 4 are mounted on the upper frame, which constitute an upper unit 1A.

On the lower frame, the above-mentioned paper supply cassette 2, the transfer charger 25, the separating charger 26, the convey path 28, the guide plate 39, the fixing device 29, the delivery roller pairs 30, the copy tray 3, the main motor (DC brushless motor) 35, and the power supply section 34 are mounted, which constitute a lower unit 1B. As in the conventional manner, a front cover (not shown) of the copying machine 150 is detachable, so that the copying sections from the paper supply device 26 via the convey path 28 to the copy delivery tray 3 can be exposed to the user when the paper jam occurs. As a result, the user can easily remove the jammed paper sheet to repair the malfunction of the copying machine 100.

A pair of register rollers 50 is provided to correct the inclination of the front edge of the paper sheet P which is supplied by the paper supply cassette 2, or the hand feed-in paper supplier 15, and also to adjust the transport timing of the paper sheet P to the transfer charger 25 in synchronism with the formation of the toner image on the photosensitive drum 20. A detector switch for hand feed-in operation is positioned in front of the register roller pair 50.

Reference numerals 52, 53, 54 and $55_1$; $55_2$ indicate a delivery switch, a total copy counter, a paper depletion switch for detecting the depletion of the paper sheets in the paper supply cassette 2, and doctor blades for controlling the thickness of the developer layers of the developers $24_1$; $24_2$, respectively. Further, reference numerals $56_1$; $56_2$, $57_1$; $57_2$, $58_1$; $58_2$ and $59_1$; $59_2$ respectively indicate toner hoppers, toner depletion detectors, toner concentration detectors, and lids of the toner hoppers. The original document supporter 4 cannot be operated unless these lids $59_1$, $59_2$ are closed.

There is also arranged a high voltage transformer 60, a discharge brush 61, a handle 62 for opening the upper unit A, a reflector 63 for surrounding the back side of the exposure lamps 22, and an auxiliary reflector 64.

A weight 65 is to push a cleaning blade 65 of the cleaning device 31 to the photosensitive drum 20 at a constant pressure. The cleaning blade 65 is controlled by a solenoid (not shown) for the touch and detachable actions.

The above-described toner depletion detector $57_1$ is constructed from a magnet $42_1$ positioned at the tip of a rotatable object $41_1$, and a lead switch $43_1$ positioned at the outer side of the toner hopper $56_1$. The rotatable object $41_1$ rotates in response to a quantity of the toner particles contained in the toner hopper $56_1$. Similarly the toner depletion detector $57_2$ is constituted by a magnet $42_2$ positioned at the tip of a rotatable object $41_2$, and a lead switch $43_2$ positioned at the outer side of the toner hopper $56_2$.

The reflector 63, auxiliary reflector 64 and lens array 23 are assembled in one unit.

The paper supply device 26 provided in the right lower portion of the copying machine 100 is constructed by the paper supply cassette 2, the hand feed-in tray 15 and the paper supply roller 38 for feeding the paper sheet P one by one from the paper supply cassette 2. The hand feed-in tray 15 is formed on the cassette cover which surrounds an opening for taking out the paper sheet, a separating pin being positioned on the upper side of the paper supply cassette 2.

Detailed Description of the Reproduction Apparatus

Operation Panel

Figure 2:
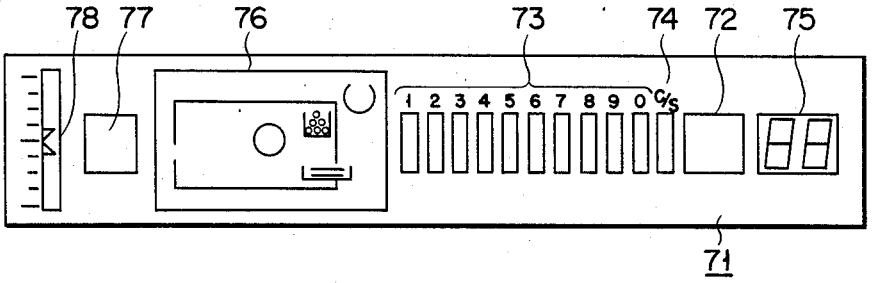
FIG. 2 shows a plan view of an operation panel of the copying machine shown in FIG. 1.

Referring to FIG. 2, an operation panel 71 is shown. The operation panel 71 is provided with a copy key 72, a set key 73 for setting a quantity of the copies to be duplicated, a clear/stop key 74 for clearing the preset copy quantity and for immediately stopping the copying operation, a copy counter 75 for displaying the number of the copies that is subtracted from the preset copy number, a display section 76 for pictorially displaying the operation conditions and also the colour selection, a colour selection switch 77 for selecting the first monochromatic developer $24_1$ (black toner particles) and the second monochromatic developer 242 (red toner particles), and a concentration selector 78 for the one-coloured copies.

Display Section

During the operation of the copying machine 100, various conditions will or can exist which should be made known to a machine operator. To this end, a plurality of visual indicators are provided on the display panel for informing the operator that a particular condition exists. Especially, according to the present invention, the visual indicator can display which colour toner is selected to produce one-coloured copies.

Figure 3A:
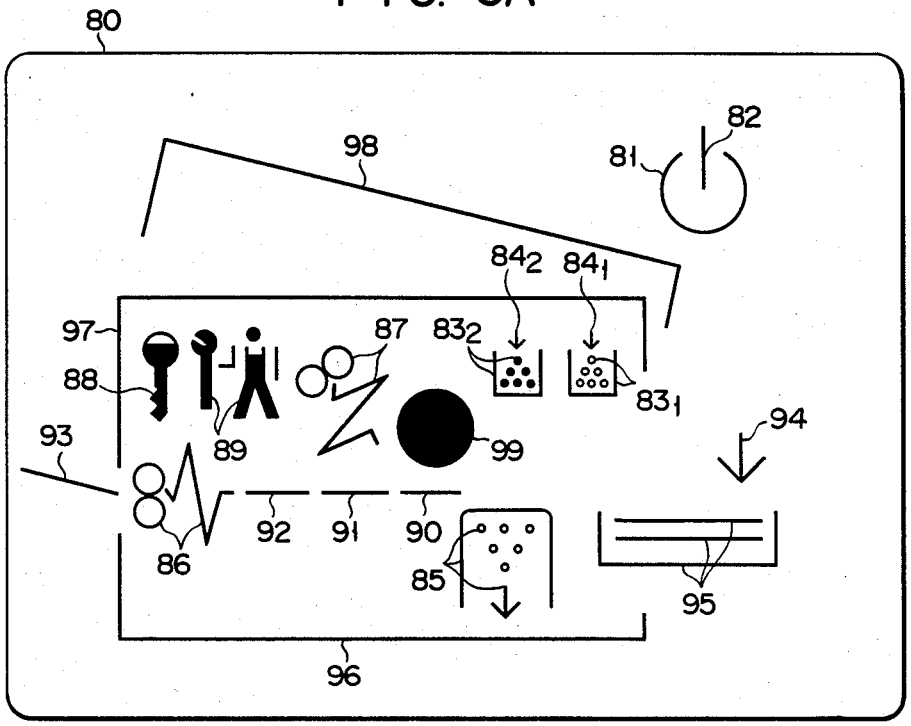
FIG. 3A shows a pictorial diagram of a display panel employed in the copying machine.
Figure 3B:
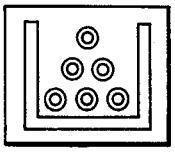
FIG. 3B shows an enlarged pictorial diagram of a toner display in the display panel.

In FIG. 3A, a pictorial diagram of component segments (referred to as "segments") is shown which are illuminated by the liquid crystal diodes. These segments represent the components and the outlines of the copying machine 100. Reference numeral 80 indicates the liquid crystal diode panel. Segments 81, 82 denote whether the copying machine 100 is ready for copying. The segment 81 indicates that the copying machine 100 is ready for copying and both the segments 81, and 82 indicate the warming condition of the copying machine 100. The segment $83_1$ pictorially illustrates the hopper of the black developer $24_1$. When the segment $83_1$ is illuminated, the black developer $24_1$ is selected to produce the black copies. In actuality, the background of the LCD (liquid crystal diode) display panel 80 is coloured black, and the pictorial segment $83_2$ indicates the hopper of the red developer $24_2$. The function of this segment $83_2$ is the same as the segment $83_1$. Therefore, no further detailed explanation is made in this specification. Segments $84_1$ and $84_2$ indicate the depletion of the black and red toners, respectively. A segment 85 indicates that the toner particles are loosened from the drum surface, and the toner collector is fully filled with the collected toner particles. A segment 86 denotes a paper jam occurring in the fixing device 29 or the adjacent convey path. A segment 86 denotes a paper jam occurring in the fixing device 29 or the adjacent convey path. A segment 87 indicates a paper jam occurring in the drum 20 or the cleaning device 31 into which the paper sheet P has accidently been brought. A segment 88 indicates "call a key operator". A segment 89 denotes "call a repairing engineer". A series of segments 90 to 93 indicate the paper convey condition. A segment 95 indicates that the paper supply cassette 2 is loaded in the correct set position. A segment 96 indicates the lower cover of the copying machine 100, and a segment 97 indicates the upper cover thereof. A segment 98 indicates that the upper document cover is opened. A segment 99 represents the photosensitive drum 20. In FIG. 3A, the black copies are produced by selecting the black developer $24_1$. As is easily understood from the technical field, a common electrode 123 (see FIG. 4) of the LCD display panel 80 is arranged opposite to those segments 81 to 99.

System Control Circuit Diagram

Figure 4:
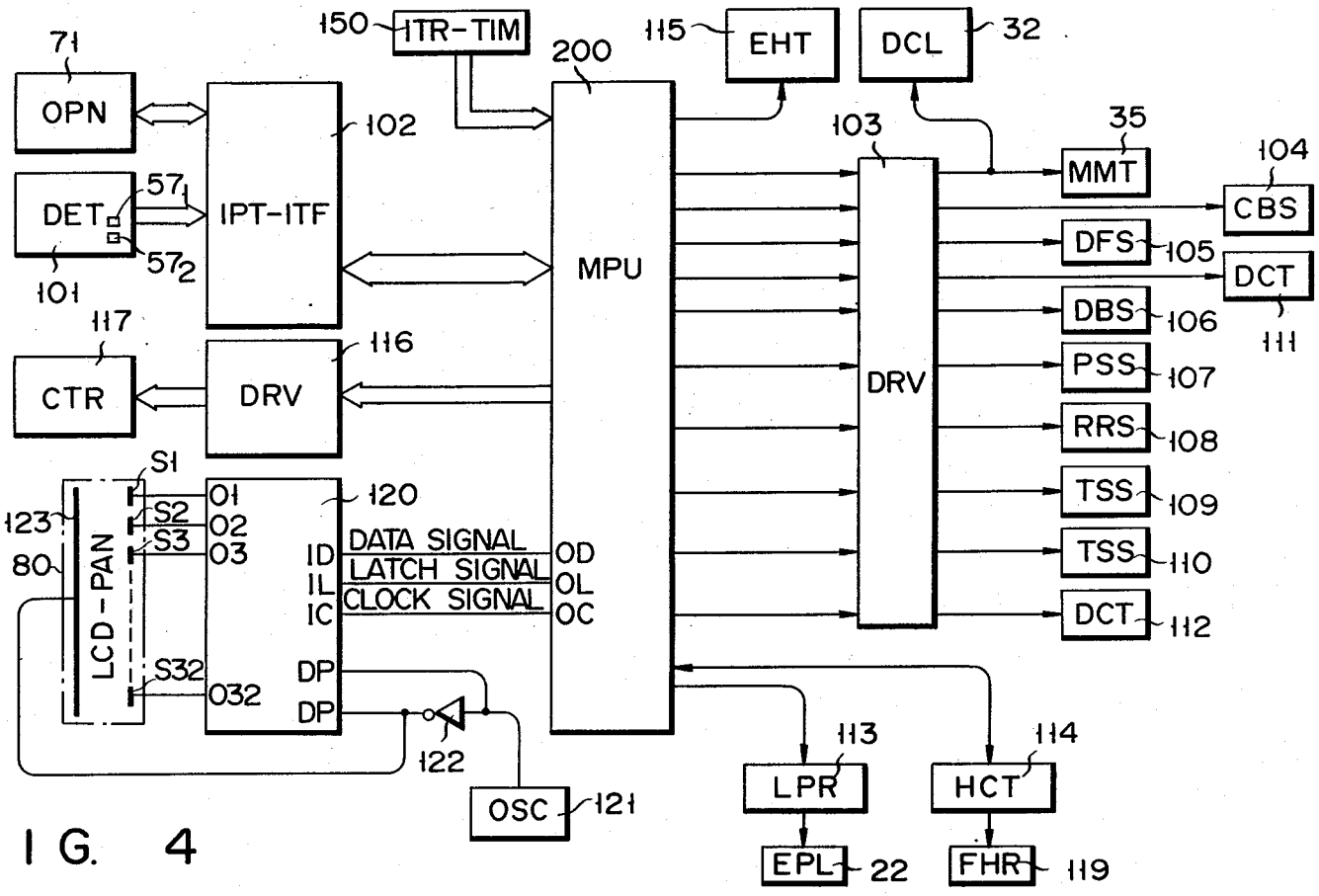
FIG. 4 is a schematic circuit diagram of a system control circuit of the copying machine.

Various modes of the copying machine 100 is provided through a control means (main processing unit 200) which is adapted to receive the operating mode selected by a machine operator through the operation panel 71 and the detector members 101. A system control circuit diagram is shown in FIG. 4. In general, the main processing unit 200 is arranged as a logic processor which continuously operates upon an execution program stored in the memory means, such as a read-only memory (ROM).

Referring to FIG. 4, the main processing unit (referred to as an "MPU") 200 is coupled to various actuating elements and control means. Various operating mode keys 72 to 78 of the operation panel 71, and various detector members 101, e.g., the detector for depletion of the toner particles $57_1$, $57_2$ are connected via an input interface 102 to the MPU 200. This MPU 200 is coupled through the drivers 103 and 116 to the following actuation components; the discharge lamp (DCL) 32, the main motor (MMT) 35, the cleaning blade solenoid (OBS) 104 for driving the cleaning blade 66, the solenoid (DFS) 105 for advancing the document supporter 4, the solenoid (DBS) 106 for returning the document supporter 4, the solenoid (PSS) 107 for driving the paper supply rollers, the solenoid (RRS) 108 for driving the register rollers 50, the solenoids (TSS) 109 and 110 for replenishing the toner particles, and the developer control circuits (DCT) 111 and 112. These solenoids (PSS, RRS) 107 and 108 control to actuate the spring clutches (not shown) which are connected between the driving source and the register rollers 38 or the paper supply rollers 50. The solenoids (TSS) 109 and 110 replenish the toner particles from the toner hoppers 561 and 562 to the black and red developers $24_1$ and $24_2$ when the content of the toner particles in the developers $24_1$ and $24_2$ is detected by the detectors $58_1$ and $58_2$ to be lower than the predetermined value. The developer control circuits 111 and 112 select the black developer 24, or the red developer 242 in such a way that the selected developer contacts the drum 20, these control circuits are selectively energized by the colour selection switch 77.

An exposure lamp regulator 113, a heater control circuit 114, a high tension transformer 115 and a display circuit of copy counter 117 are connected via a driver circuit 103 to the MPU 200. The lamp regulator 113 controls the power supplied to the exposure lamp 22. The high tension transformer 115 applies the predetermined voltages to the charger 21, the transfer charger 25, the separating charger 27, etc. in response to the control signals generated by the predetermined program in the ROM of the MPU 200. The heater control circuit 114 controls the power dissipation of the fixing heater 119 of the fixing device 29 so that the temperature of the fixing device 29 can be maintained at the fixing temperature. The display circuit 117 selectively turns on the numerical LED segments of the display section of the copy counter 75.

TABLE 1

| Electrodes segments shown in FIG. 4 | Component segments shown in FIG. 3A | Electrodes segments shown in FIG. 4 | Component segments shown in FIG. 3A |
|---|---|---|---|
| $S_1$ | $83_2$ (red copies) | $S_{17}$ | 97 |
| $S_2$ | $84_2$ (red toner depletion) | $S_{18}$ | 98 |
| $S_3$ | $83_1$ (black copies) | $S_{20}$ | 81 |
| $S_4$ | $84_1$ (black toner depletion) | $S_{20}$ $S_{20}$ | 82 |
| $S_5$ | 86 | $S_{21}$ | — |
| $S_6$ | 87 | $S_{22}$ | — |
| $S_7$ | 88 | $S_{23}$ | — |
| $S_8$ | 89 | $S_{24}$ | — |
| $S_9$ | 90 | $S_{25}$ | — |
| $S_{10}$ | 91 | $S_{26}$ | — |
| $S_{11}$ | 92 | $S_{27}$ | — |
| $S_{12}$ | 93 | $S_{28}$ | — |
| $S_{13}$ | 85 | $S_{29}$ | — |
| $S_{14}$ | 95 | $S_{30}$ | — |
| $S_{15}$ | 94 | $S_{31}$ | — |
| $S_{16}$ | 96, 99 | $S_{32}$ | — |

One of the functions of the MPU 200 is to convert various copying conditions into a 32-bit coded signal, and to deliver a latch signal and a clock signal. The 32-bit coded signal is derived from the output terminal OD of the MPU 200. The latch signal is derived from the output terminal OL of the MPU 200. The clock signal is derived from the output terminal OC of the MPU 200. A detailed description will be made later.

A drive circuit of the liquid crystal diode (LCD) 120 receives at its input terminal ID various kinds of the data signals from the MPU 200 in response to the clock signal. An oscillator 121 oscillates an LCD drive signal at the adequate frequency. This drive signal is used as an LCD drive pulse A, and is inverted by the inverter 122 to derive an LCD drive pulse B. Accordingly, there exists a complementary relation between these drive pulses A and B. Each of the output signals appearing at the output terminals $O_1$ to $O_{32}$ of the LCD drive circuit 120, is applied to the corresponding electrodes $S_1$ to $S_{33}$ of the liquid crystal diodes in the LCD display panel 80. A common electrode 123 positioned opposite to these electrodes $S_1$ to $S_{33}$ receives the drive pulse B which is derived from the inverter 122.

The electrodes $S_1$ through $S_{32}$ of the LCD panel 80 correspond to the segments 81 through 99 of the LCD panel 80. The segments 96 and 99 (lower panel and photosensitive drum) are connected to the same electrode $S_{16}$. It should be noted that although two different terms "electrodes" and "segments" are introduced in this specification, they denote the same electronic components of the LCD display panel 80.

Drive Circuit For LCD Panel

Figure 5:
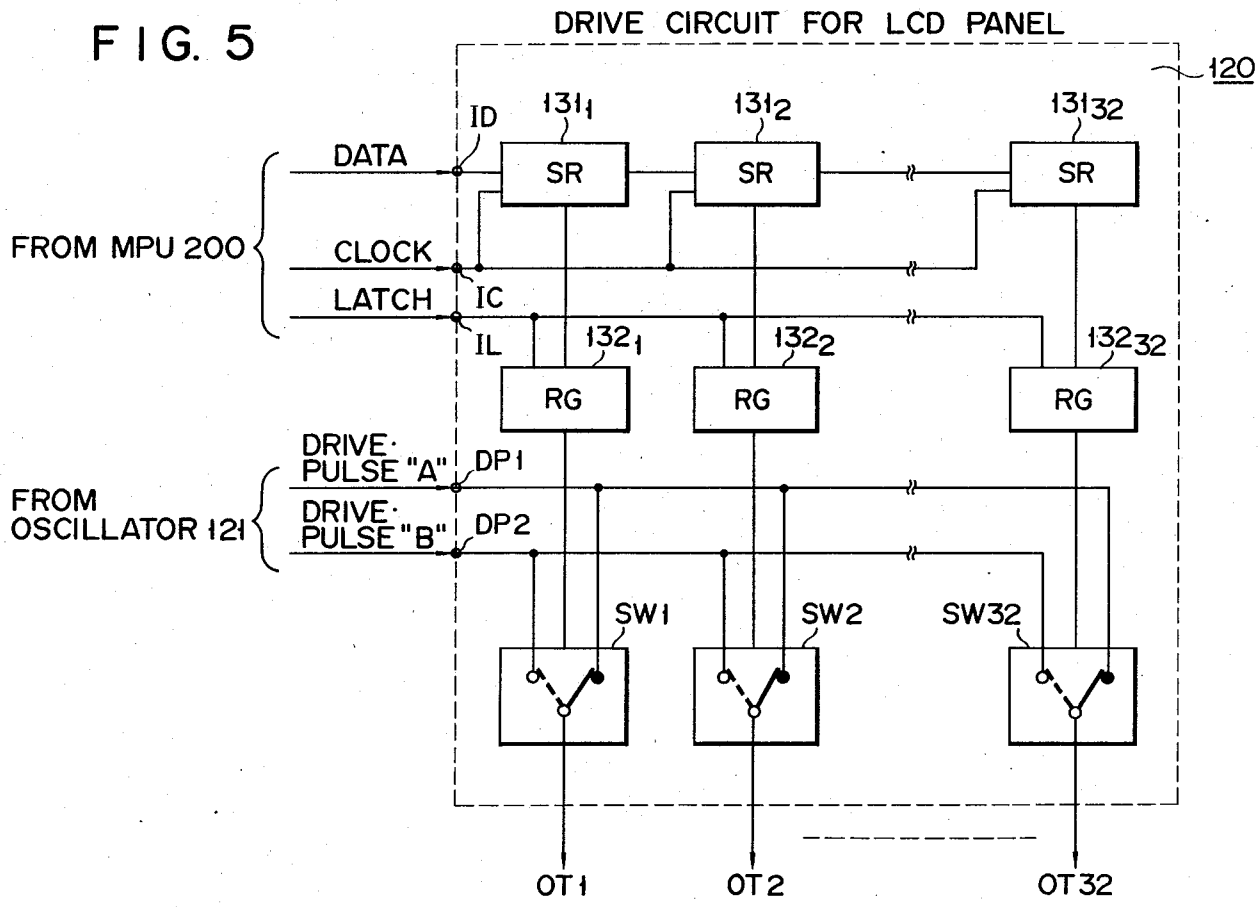
FIG. 5 is a schematic circuit diagram of a drive circuit for the display panel.

FIG. 5 shows details of the drive circuit 120 for the LCD panel 80. In the circuit, thirty-two (32) shift registers $131_1$ to $131_{32}$ are cascade-connected, the data signal is supplied at first to a first stage shift register $131_1$, and the clock signal is supplied to all of the shift registers $131_1$ to $131_{32}$. Accordingly, the data signal derived from the first output terminal OD of the MPU 200 is transferred in turn from each shift register $131_1$ through $131_{32}$ via the input terminal ID of the drive circuit 300 in synchronism with the clock signal derived from the third output terminal OC via the input terminal IL. The storage registers $132_1$ to $132_{32}$ are directly connected to each shift register $131_1$ through $131_{32}$, which may store the contents of each shift register $131_1$ through $131_{32}$ by the latch signal derived from the second output terminal OL via the input terminal IL. The storage registers $132_1$ to $132_{32}$ may control to turn ON/OFF switches SW1 through SW32 in accordance with the contents stored therein, so that either the drive pulse A or the drive pulse B is selectively derived from output terminals OT1 through OT32 of the drive circuit 120. That is, when, for example, the content of the storage register $132_1$ is "1", the drive pulse A is delivered from the output terminal $O_1$, and when the content of the storage register $132_{32}$ is "0", the drive pulse B is derived from the output terminal $O_{32}$.

Selected Mode of Operation

Waiting

Figure 6:
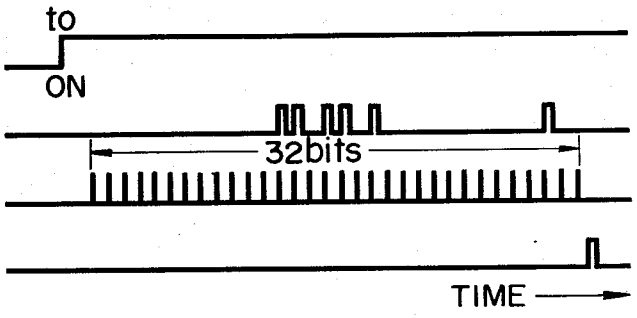
FIGS. 6, 9, 12, 15 and 18 show waveform charts of signals derived from the MPU shown in FIG. 4.
Figure 7:
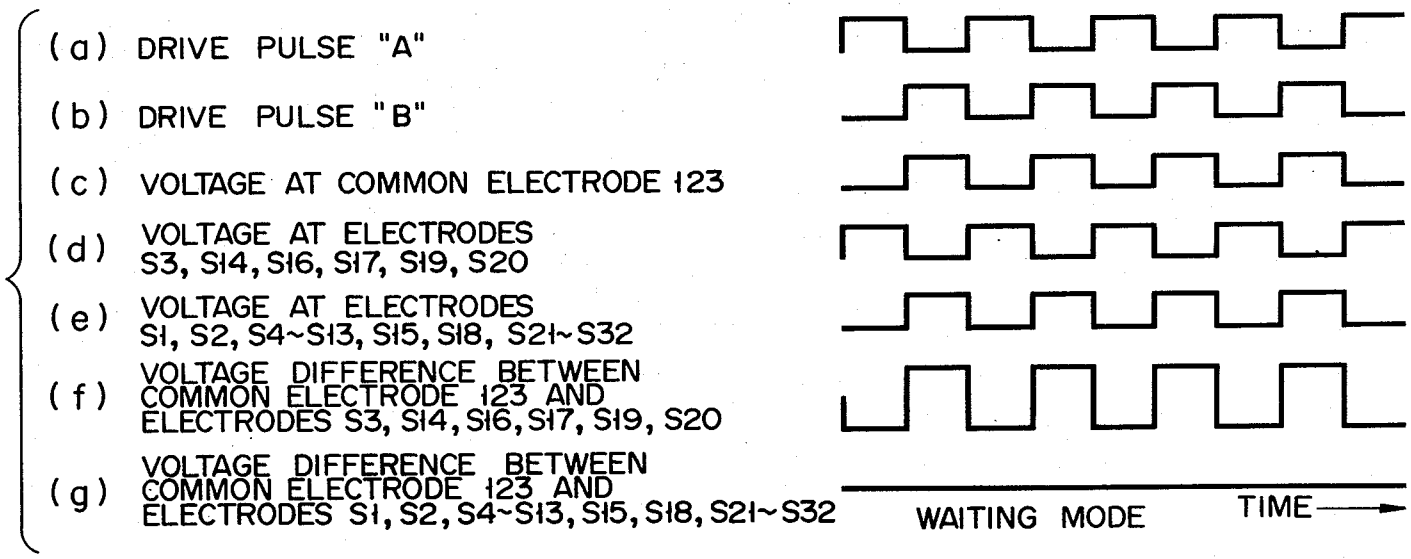
FIGS. 7, 10, 13, 16 and 19 show waveforms of voltages applied to electrodes of the display panel.
Figure 9:
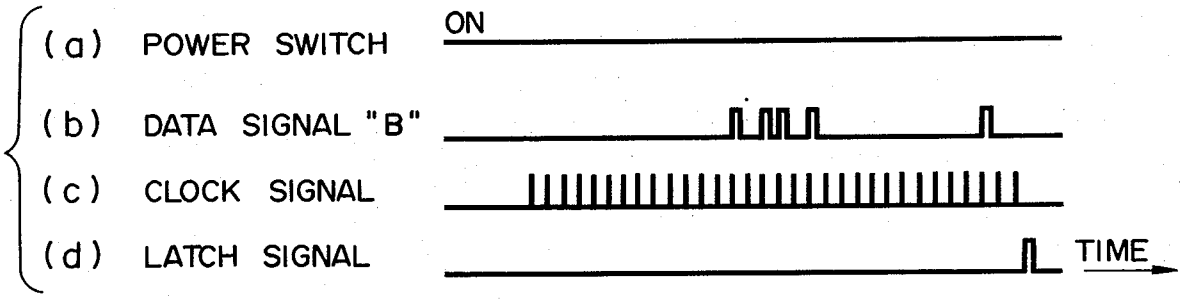
Figure 10:
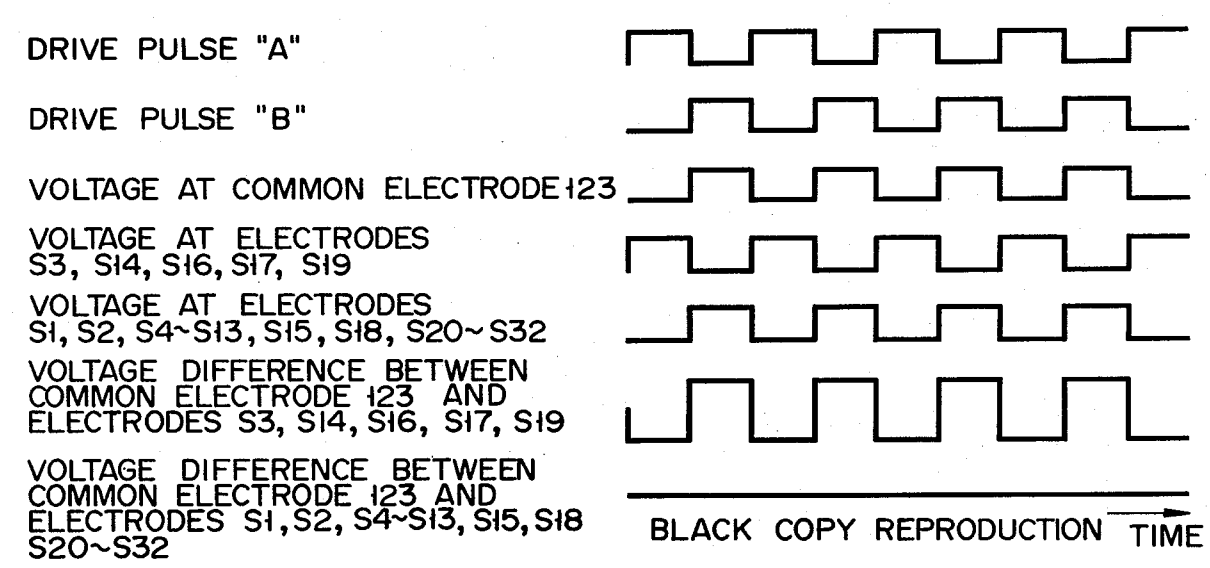
Figure 12:
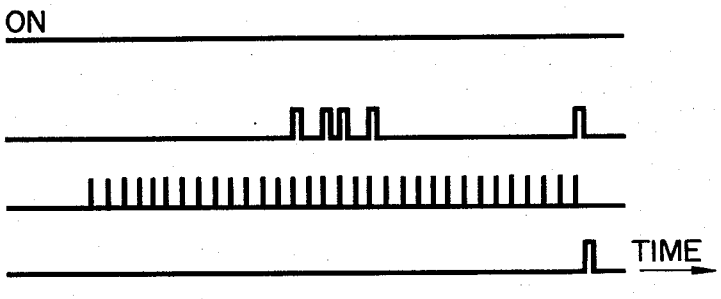
Figure 13:
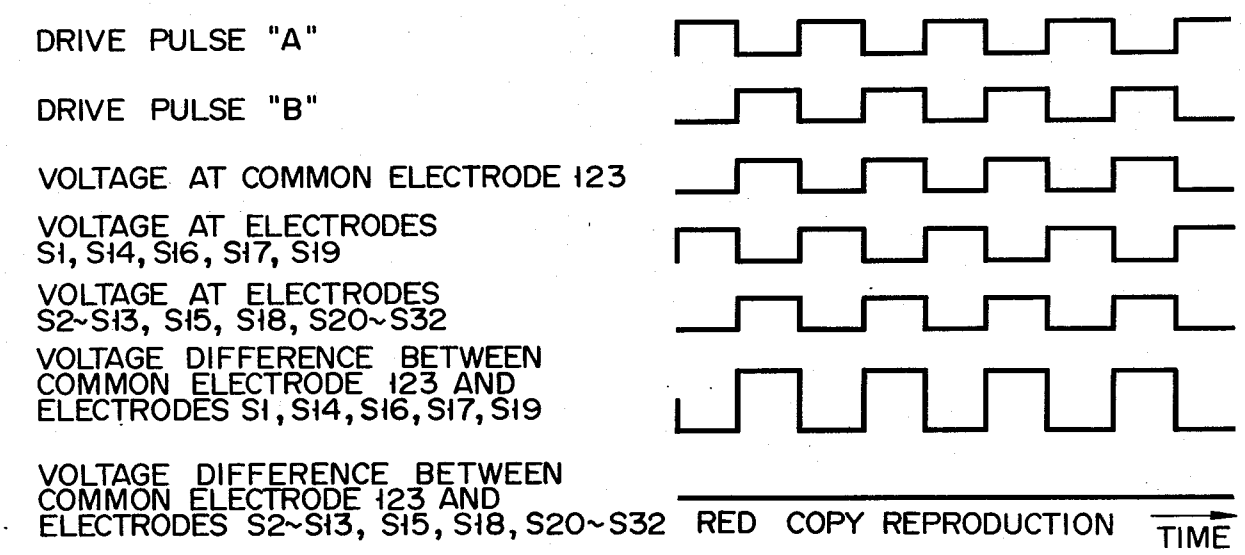

A description will now be made of the various selected modes of operation. First, a "WAITING" mode of the copying machine 100 will be described with reference to FIGS. 9, 10 and 11. In FIG. 6, when the power switch (not shown) of the copying machine 100 is turned ON at an instant "to", the MPU 200 commences its operation in built-in accordance with a predetermined program stored in the ROM, and the fixing heater 119 of the fixing device 29 is energized. Since at that instant "to" the temperature of the fixing device 29 does not yet reach the given fixing temperature, an indication of "WAITING" mode is made on the LCD panel 80 (See FIG. 8).

In this embodiment, the copying machine 100 is so designed that when the power switch is turned ON, the black developer $24_1$ is automatically selected. Accordingly, a 32-bit data signal (00100000000001011011000000000000) (referred to as a "data signal A") is derived from the output terminal OD of the MPU 200.

Figure 8:
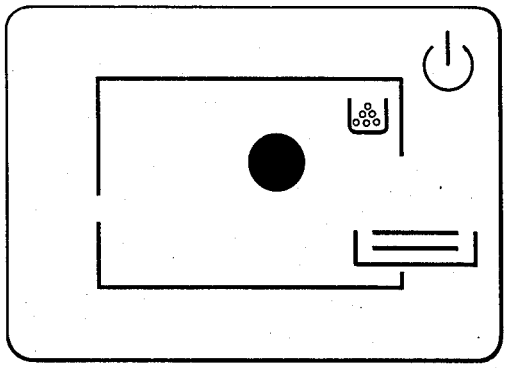
FIGS. 8, 11, 14, 17 and 20 are pictorial displays of the display panel for various operation modes.

In this case, as previously explained, this data signal is output in synchronism with the clock signal derived from the output terminal OC and, after the 32nd bit signal is transferred, the latch signal is output from the output terminal OL. As a result, the above-mentioned data signal A is stored in the storage registers $132_1$ through $132_{32}$ in the drive circuit 120. Then the drive pulse A is derived from the output terminals OT3, OT14, OT16, OT17, OT19 and OT20 connected to the storage registers $132_3$, $132_4$, $132_{16}$, $132_{17}$, $132_{19}$ and $132_{20}$, respectively whose contents are "1". Therefore the drive pulse A is applied to each of the electrodes S3, S14, S16, S17, S19 and S20 as segment drive signals. The drive pulse B is derived from the output terminals OT1, OT2, OT4 to OT13, OT15, OT18 and OT21 to OT32 corresponding to the storage registers $132_1$, $132_2$, $132_4$ to $132_{13}$, $132_5$, $132_{18}$ and $132_{21}$ to $132_{32}$, respectively, whose contents are "0". Therefore the drive pulse B is applied to each of the electrodes S1, S2, S4 to S13, S15, S18 and S21 to S32 of the display panel 80 as a complementary segment drive signal. In this condition, since the drive pulse B is also applied to the common electrode 123 of the liquid crystal display panel 80, an AC voltage as shown in FIG. *7f* is being applied between the common electrode 123 and the electrodes S3, S14, S16, S17, S19 and S20 respectively. In other words, the AC voltage shown in FIG. *7f* is equal to the difference in potential of each of the electrodes against the potential of the common electrode 123. As a result, the electrodes S3, S14, S16, S17, S19 and S20, namely each segment 83, 95, 96, 97, 81, 82 and 99 (see FIG. 3A), is illuminated. On the other hand, all the electrodes except the above-mentioned electrodes, i.e., S1, S2, S4 to S13, S15, S18, and S21 to S32, receive a voltage as shown in FIGS. *7c* or *7e*, which is in phase with the voltage the drive pulse B applied to the common electrode 123 so that they are not energized because they have no potential difference, as shown in FIG. *7g*. In other words, each of the segments $83_2$, $84_2$, 85 to 94 and 98 of the panel 80 shown in FIG. 3A is not illuminated. Consequently, the display panel 80 shows such a pictorial diagram of FIG. 8 to indicate that the copying machine 100 is in the waiting condition and the black developer $24_1$ has been selected. As previously described, the black developer $24_1$ has priority over the red developer $24_2$ in the colour selection mode. The segment $83_1$ of the LCD display panel 80 is illuminated as shown in FIG. 8.

Ready for copying black copies

After the above-described warming-up, the copying machine 100 is ready for copying. Under this condition, the reproduction of black copies can commence. The copying key 72 (FIG. 2) is allowed to be depressed after the temperature of the fixing heater 119 (FIG. 4) reaches a given fixing temperature. When the copying machine 100 becomes "READY", a 32-bit data signal (00100000000000101101000000000000) (referred to as a "data signal B") is output from the MPU 200 through the data signal output OD. As a result, since all the storage registers $132_1$ to $132_{32}$ hold the above-mentioned data signal B, the drive pulse A is delivered from the output terminals OT3, OT14, OT16, OT17 and OT19 that correspond to the storage registers $132_3$, $132_{14}$, $132_{16}$, $132_{17}$ and $132_{19}$, respectively, whose contents are "1", said drive pulse A being applied to the respective electrodes S3, S14, S16, S17 and S19. On the other hand, the drive pulse B is output from the output terminals OT1, OT2, OT4 to OT13, OT15, OT18 and OT20 to OT32 connected to the storage registers $132_1$, $132_2$, $132_4$ to $132_{13}$, $132_{15}$, $132_{18}$ and $132_{20}$ to $132_{32}$, respectively, the contents of which are "0" and is then applied to the corresponding electrodes S1, S2, S4 to S13, S15, S18 and S20 to S32. In this case, as the drive pulse B is also applied to the common electrode 123 as in the waiting mode, an AC voltage as shown in FIG. 10*f* should be also applied between the common electrode 123 and the respective electrodes S3, S14, S16, S17 and S19. Accordingly, the electrodes S3, S14, S16, S17 and S19, namely each segment 83, 95, 96, 97 and 81 are illuminated. Since the voltage whose phase is the same as that applied to the common electrode 123 shown in FIGS. 10*c* or 10*e*, is applied to the remaining electrodes S1, S2, S4 to S13, S15, S18, and S20 to S32, those electrodes i.e., the segments 82, $83_2$, $84_1$, 85 to 94 and 98 are not illuminated. This condition can be seen in the pictorial diagram in FIG. 11, in which the segment S3 for the black copy (the electrode $83_1$ of the LCD panel 80) is especially illuminated.

Ready for copying red copies

When the colour selection switch 77 is actuated to select the red developer $24_2$, the reproduction mode for the red copies is prepared. As has been explained before, in accordance with the present embodiment, the black developer $24_1$ has priority over the red developer $24_2$ in the copying operation. Consequently, the black developer $24_1$ is automatically selected in the following conditions. That is, first, the power switch is turned on, and second, a given time passes, e.g., 30 seconds after the red developer $24_2$ has been selected and no further demand has been made. In other words, if the copying machine 100 meets the above-described conditions, the user must actuate the colour selection switch 77 for the red developer $24_2$, while the colour selection operation is carried out, an indication "WAITING" is displayed during which no copy is reproduced. In other words, the indication "WAITING" is kept lightened until the black developer $24_1$ is mechanically released from the photosensitive drum 20 and the red developer $24_2$ is in contact with the drum 20. The indication "WAITING" of the LCD panel 80 is the same as that of "READY FOR COPY" in addition to the segment for red copy 82 (electrode $S_{20}$).

When the red developer $24_2$ is set to the normal position, a 32-bit data signal, i.e., (10000000000001011010000000000000) is derived from the MPU 200 (referred to as a "data signal C"). As a result, AC voltage is applied between only the electrodes $S_1$, $S_{14}$, $S_{16}$, $S_{17}$, $S_{19}$ and the common electrode 123, so that the segments $83_2$, 95, 96, 97 and 81 of the LCD panel 80 are turned on (illuminated) and also the segments 82, $83_1$, $84_1$, $84_2$, 85 through 94, and 98 are turned off. This condition (black copy reproduction) is pictorially shown in FIG. 14 where the outline of the copying machine 100 as well as the segment $83_2$ (electrode $S_1$) for red copies are illuminated, the segment $83_2$ being illuminated, for example, in red. Then the red copy reproduction is prepared.

Depletion of black toner particles

Figure 17:
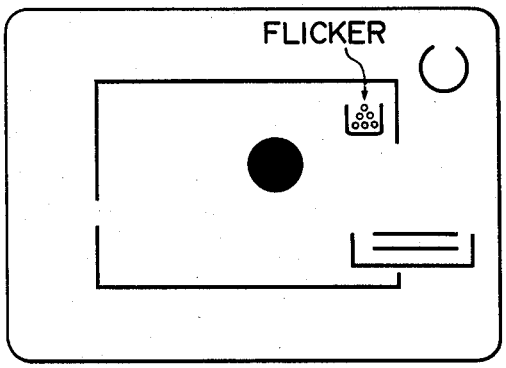
Figure 16:
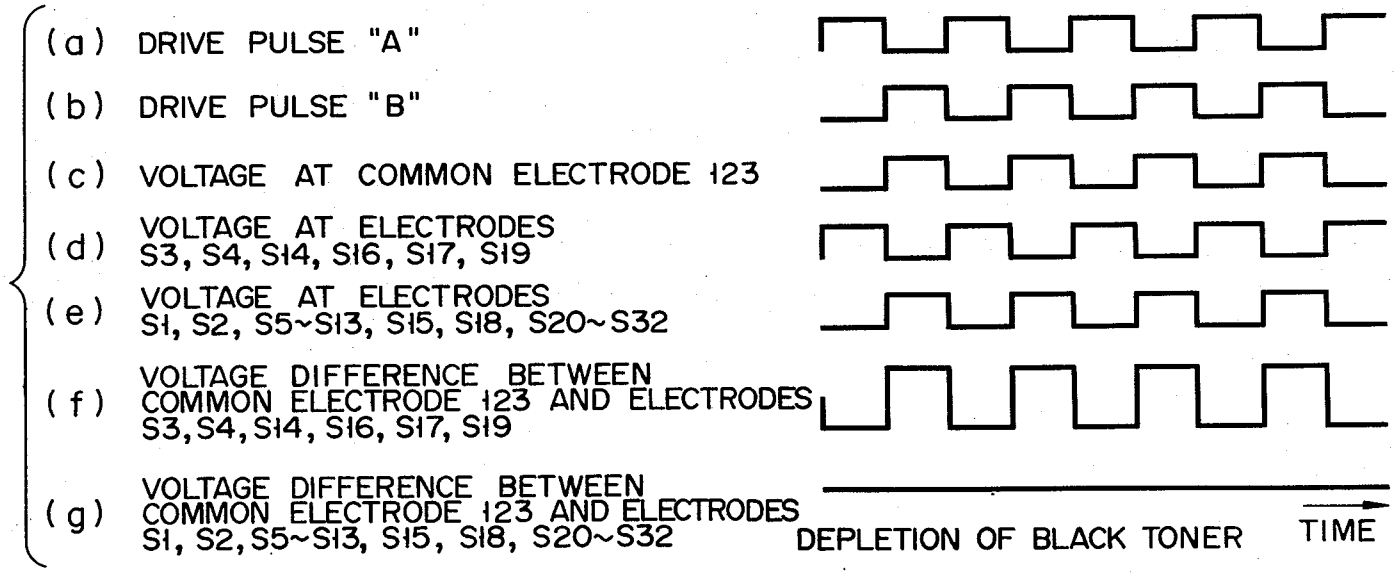
Figure 18:
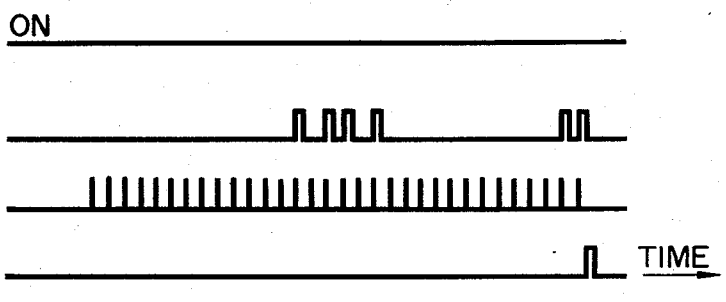

During the copying mode of the black copies, the depletion of black toner particles in the black developer $24_1$ can be detected by the detector $57_1$. When the detection signal is generated from the detector $57_1$, it is supplied via the input interface 102 to the MPU 200. Upon receipt of the detection signal, the MPU 200 produces alternately the data signal B (00100000000001011010000000000000) and also a new data signal D (00110000000001011010000000000000) for biassing the electrode S4 (the arrow-shaped segment $84_1$ of the panel 80) in synchronism with the output pulse of the oscillator 121 (see FIG. 16). While only the former data signal B is output from the MPU200 to the LCD drive circuit 120, the electrodes S3, S14, S17 and S19 are biased at the give voltage, i.e., the segments $83_1$, $84_1$, 95, 96, 97 and 81 being illuminated as shown by the pictorial diagram of FIG. 11. On the other hand, while only the latter data signal D is derived from the MPU 200, the segments $83_1$, $84_1$, 95, 96, 97 and 81 of the display panel 80 are illuminated as shown in FIG. 17. Accordingly, the segment for the black toner $83_1$ is continuously illuminated and also the segment for the depletion of the black toner $84_1$ flickers at a given time period, e.g., 50 Hz, resulting in an indication for the depletion of the black toner.

It should be noted that even if the segment for the depletion of the black toner flickers, the copying machine 100 can be operated without any interruption for the time being.

Depletion of red toner particles

Figure 20:
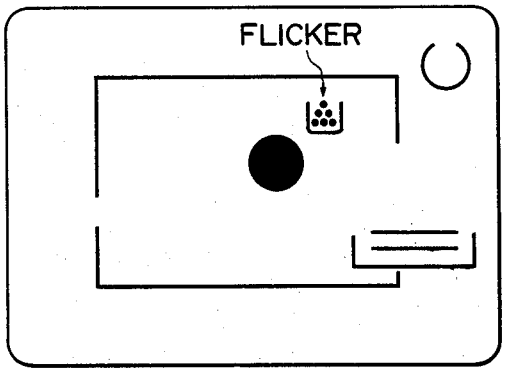
Figure 15:
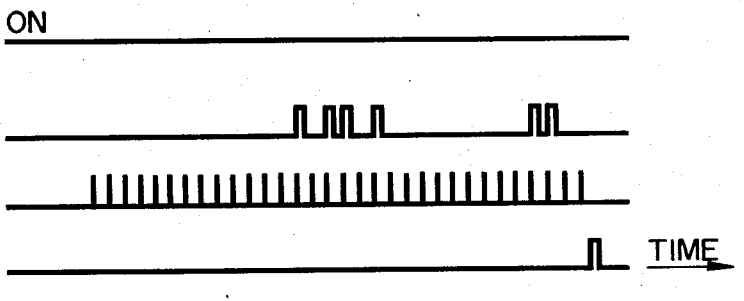
Figure 19:
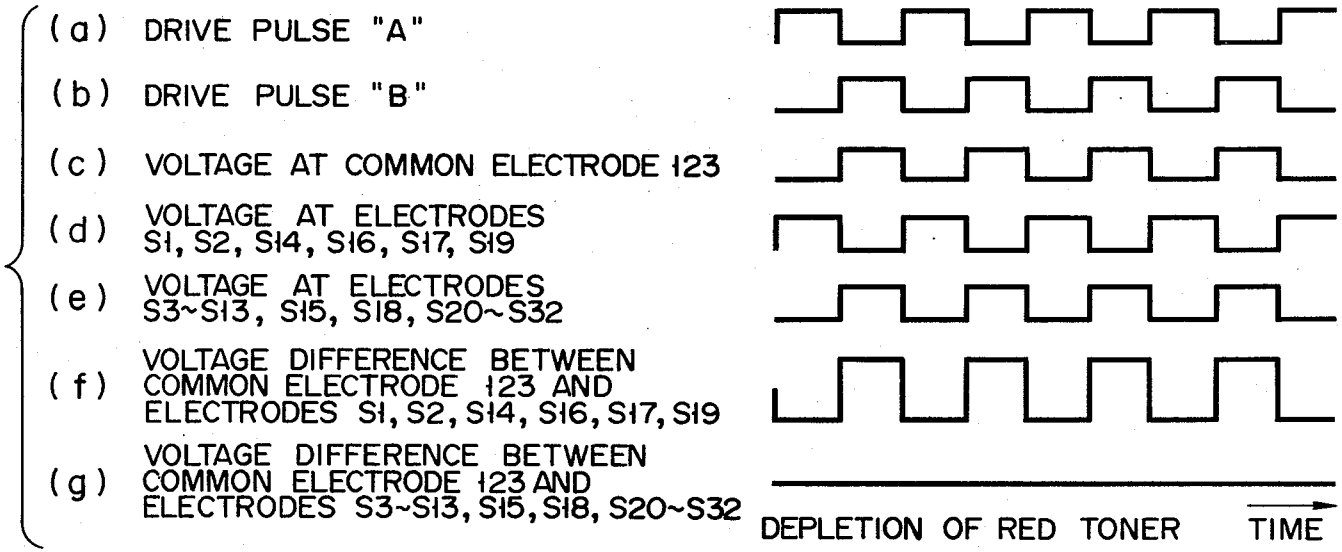

During the copying mode of the black copies, the depletion of black toner particles in the red developer 242 can be detected by the detector $57_2$. When the detection signal is generated from the detector $57_2$, it is supplied via the input interface 102 to the MPU 200. Upon receipt of the detection signal, the MPU 200 produces alternately the data signal C (10000000000001011010000000000000) and also a new data signal E (11000000000001011010000000000000) for biassing the electrode S2 (the arrow-shaped segment 842 of the panel 80) in synchronism with the output pulse of the oscillator 121 (see FIG. 19). While only the former data signal C is output from the MPU 200 to the LCD drive circuit 120, the electrodes S1, S14, S15, S17 and S19 are biased at the given voltage, i.e., the segments $83_2$, 95, 96, 97 and 81 being illuminated as shown by the pictorial diagram of FIG. 14. On the other hand, while only the latter data signal E is derived from the MPU 200, the segments $83_2$, $84_2$, 95, 96, 97 and 81 of the display panel 80 are illuminated as shown in FIG. 20. Accordingly, the segment for the red toner $83_2$ is continuously illuminated and also the segment for the depletion of the red toner $84_2$ flickers at a given time period, e.g., 50 Hz, resulting in an indication for the depletion of the red toner. It is possible to use a yellow filter for the segment $83_2$, thereby illuminating it in yellow.

It should be noted that even if the segment for the depletion of the black toner flickers, the copying machine 100 can be operated without any interruption for the time being.

Colour selection

Figure 21A:
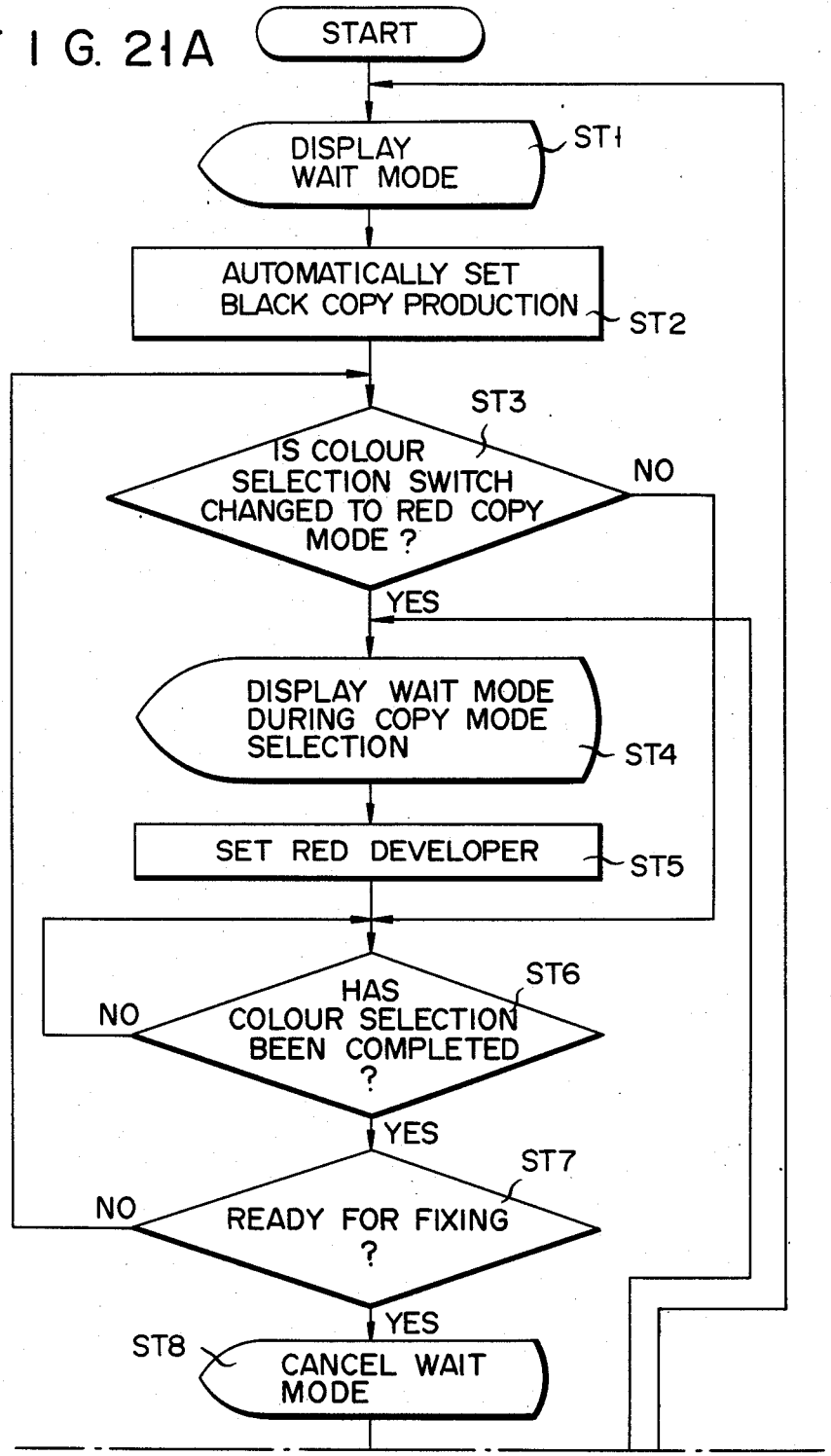
FIGS. 21A and 21B are a flow chart for explaining a copy reproduction cycle.
Figure 21B:
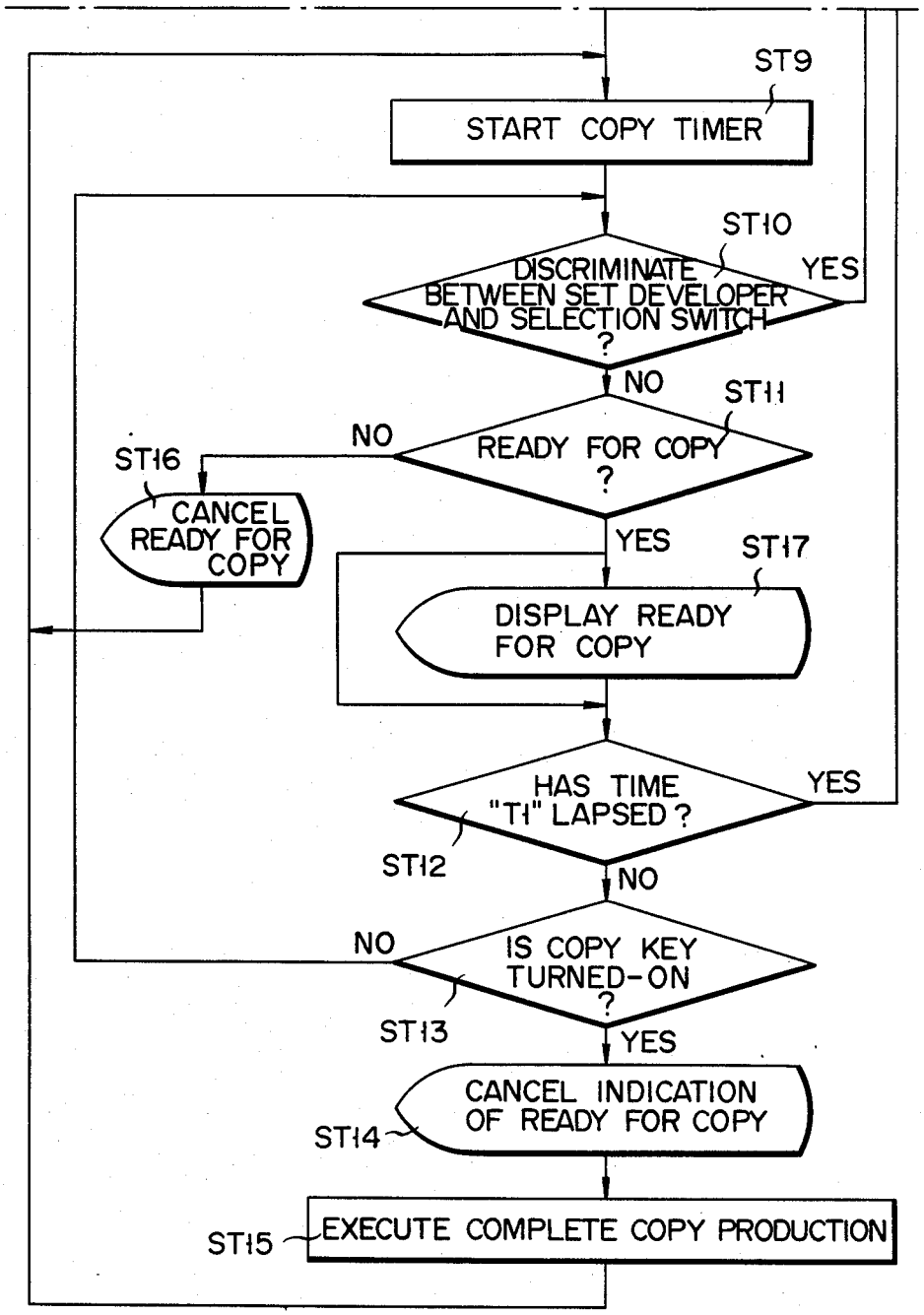

A colour selection of the copying machine 100 according to the invention is executed in accordance with the following copy process (see a flow chart of FIGS. 21A and 21B).

Upon the power switch (not shown) being turned ON, the "WAIT" mode is displayed as shown in the pictorial diagram of FIG. 8 (step 1). As previously explained, the black copy mode is automatically selected as an initial copying mode. As soon as the power switch is actuated, the MPU 200 delivers the drive signal to the developer control circuit 111 via the driver circuit 103. The black developer $24_1$ is transported to the given position adjacent to the drum 20. Then, the colour selection of the black copy mode is completed (step 2).

When the colour selection switch 77 is changed to the red copy mode, the MPU 200 detects this state through the input interface 102 (step 3). Then, a similar operation is effected for the red copy mode (steps 4 and 5). That is, the black developer $24_1$ is removed from the drum 20, and thereafter the red developer $24_2$ is conveyed to the drum 20 by the developer control circuit 112.

If, thereafter, the operator selects the black copy mode, such a substitution operation between the black and red developers 24, $24_2$ is carried out.

The MPU 200 confirms whether or not the colour selection has been accomplished (step 6). Then, it also confirms whether or not the temperature of the fixing device 29 has reached a given value (step 7). If yes, then the wait mode display is canceled (step 7).

Subsequent to the step 8, the counting operation of a built-in type copy timer of the MPU 200 starts at the step 9. Thereafter, check whether or not the set one-coloured developer corresponds to the selected one. If NO, return to the step 4 at which the normal colour developer is set to the drum 20. If YES, then check whether or not the copying machine is ready for copy (step 11). If YES, illuminate the segments indicating ready for copy (step 12). Next, check whether the given time "T1", e.g., 30 seconds has elapsed (step 12). If NO, start the copy timer at the step 9. If YES, return to the step 1, whereby a series of the copy cycle operation is again executed.

A further copy cycle operation is as follows. Check whether the copy key 72 is turned on (step 13). If NO, return to the step 10 where the colour selection is checked. If YES, turn off the indication of "ready for copy" (i.e., the segment 81, or the electrode S19) (step 14). Simultaneously, a sequence of the complete copy production consisting of the precharge, exposure, development, transfer and fixing etc. is executed at the step 15.

Thereafter, the copy timer of the MPU 200 commences again and measure the given copy time "T1". In other words, the copying machine 100 is maintained as being "ready for copy".

As already described in above, according to the present invention, the operator can recognize confirmly the colour selection unless he actually checks the colour of the selected developer by opening the front panel of the copying machine 100. For example, an advantage is that the colour selection information can be exactly given to the machine operator during the multi-copy reproduction.

Toner Depletion

Next, operation of the toner depletion will now be described with reference to a flow chart of FIG. 22. This operation is carried out by interrupting the sequence of the copy cycle (as shown by the flow chart of FIG. 21). In the ROM of the MPU 200, such an interruption process is pre-programed at a given time interval, e.g., approximately 9 milliseconds. As described in more detail hereinafter, a timer 150 is connected to the MPU 200 so as to determine the timing of the flicker events of the toner depletion segments. This timer 150 commences its counting operation when the power switch is turned on, and has a repeating cycle of approximately 0.5 second (500 milliseconds).

Figure 22:
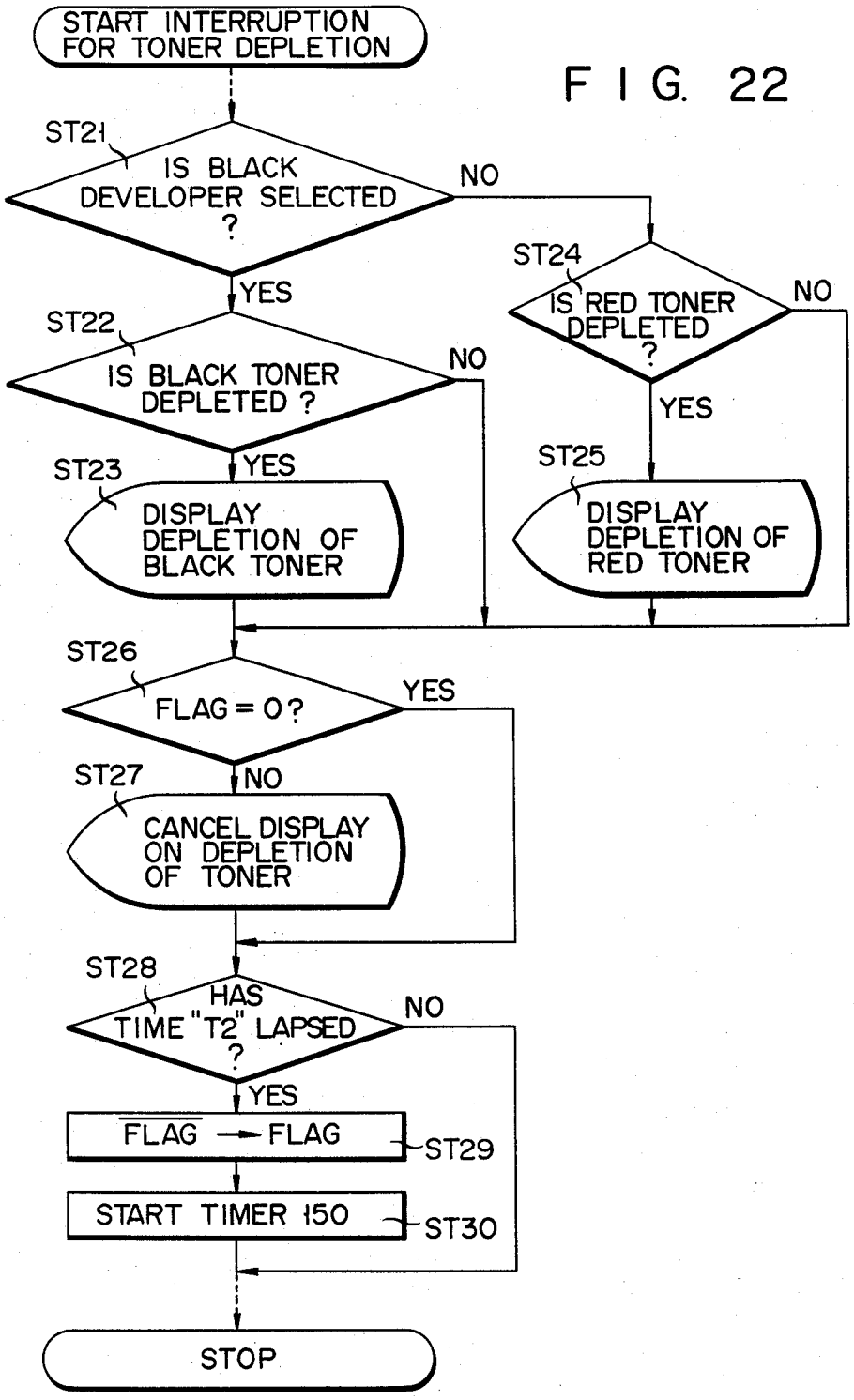
FIG. 22 is a flow chart for explaining an Interruption process for toner depletion.

Referring to FIG. 22, the first example is as follows. The developer $24_1$ or $24_2$ is replenished with the corresponding toner particles. When a given time, e.g., 10 ms (milliseconds) has elapsed since the program ran (simultaneously, the timer 150 commenced), the interruption process is excuted. At the step 21, check whether the black developer $24_1$, is selected. If YES, then check whether the black toner particles are depleted at the step 22. However, if NO, then check whether or not the red toner particles are depleted. Anyway, in this example, both the toner particles are not depleted, so that the answer is NO.

Figure 11:
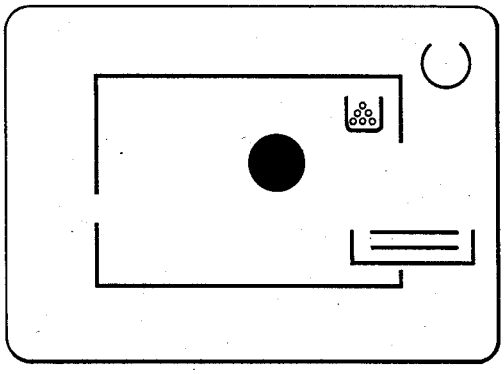
Figure 14:
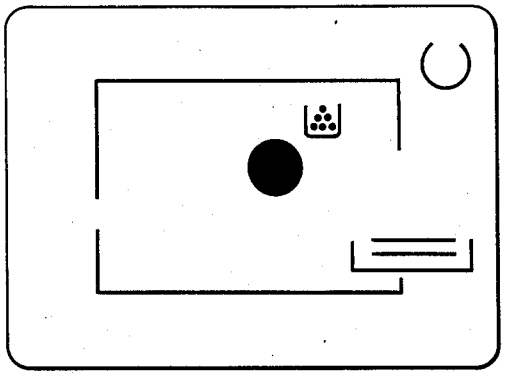

Next, the interruption process jumps to the step 26. At this step, the flicker flag which has been stored in a RAM (not shown) of the MPU 200 is checked whether it is "0" or "1". Since the flicker flag is "0" in this example, check whether the given time "T2" (0.5 second) determined by the timer 150 has elapsed (step 28). If NO, then this interruption process is accomplished. Time required for the interruption process is less than 1 millisecond, for example. A panel display of the interruption process is shown in FIG. 11 or 14.

Another interruption process different from the first example exists as a second example. In this second example, a description of the flow chart (from the step 1 until the step 26) is omitted, because the same operation occurs as in the first example. At the step 28, check whether or not the time "T2" has elapsed. Since the answer is YES in this case, the content of the flicker flag is inverted at the step 29. That is, the flag is changed from "0" to "1".

Thereafter, the counting operation of the timer 150 starts again from the starting point (O) at the step 30. Then this interruption process is completed. The panel display of this example is the same as in the aforementioned example.

As a third example, the following operation is effected. In the step 26, if the flicker flag is not equal to "0" (NO), then cancel a display of the depletion of the toner particles. Again check whether or not the time "T2" has elapsed. Thereafter, the interruption process advances to succeeding step.

A toner depletion case will now be explained.

At the step 22 or 24, the answer is YES. In addition to the segments that have been illuminated, the segment $84_1$ or $84_2$ (an arrow-shaped segment) is turned on. Then, because the flicker flag is equal to "1" at the step 26, go to the step 27 where either the segment $84_1$ or the segment $84_2$ is turned off. At the step 28, check whether or not the time "T2" has elapsed. Within the time "T2", such an interruption process is repeated several ten times, e.g., 50 times (500 ms/10 ms=50). As previously described, the content of the flag is inverted for every time-elapse "T2", so that the toner depletion segment $84_1$ or $84_2$ flickers at the time period of 0.5 second. This depletion condition is shown in the pictorial diagram of FIG. 17 or 20.

In summary, while the toner is depleted, either the segment $84_1$ or $84_2$ is illuminated (turned on) for about 1 millisecond at the step 23 or 25, and also is turned off at the step 27 during one interruption process. Within the timer cycle of the timer 150 (500 milliseconds), this turned-off condition is maintained for approximately 9 milliseconds, i.e., a time period for the normal copy cycle as shown in FIG. 21. During the succeeding interruption processes, the same operation is repeated, e.g., 50 times. Precisely speaking, although the segment $84_1$ or $84_2$ flickers within one timer cycle of the timer 150 (0.5 second), such a flicker is unseen by the operator. Namely the operator recognizes that this segment is still off. When the next copy cycle commences, the segment $84_1$ or $84_2$ is turned on at the step 23 or 25, and then is kept on, because the content of the flag has been inverted during the preceeding timer cycle, so that the step 27 is by-passed during this timer cycle. As a result, since the timer cycle of the timer 150 is repeated every 0.5 second, the segment $84_1$ or $84_2$ flickers every 0.5 second.

Multi-coloured Copy Reproduction

In the foregoing embodiments, the copy reproduced by the copying machine 100 had one-coloured (e.g., red, black) information such as characters, figures, and numbers etc. According to the present invention, it is also possible to reproduce "a multi-coloured copy" by way of the following steps. The multi-coloured copy should be understood as a copy having the multi-coloured information, that is reproduced by repeating one complete copy reproduction cycle for the monochromatic copy. That is to say, for example, three-coloured copy is reproduced by the following steps. First, plain paper is reproduced from the first original document by using the block toner particles, resulting in a copy having the black-coloured information of the first original document. Secondly, this copy is again reproduced from the second original document by using the red toner particles, resulting in a copy having the black-coloured and red-coloured information of the first and second original documents, respectively. Finally, the last-mentioned copy is again reproduced from the third original document by using the blue toner particles, resulting in a copy having three kinds of colour information (in black, red and blue) for three sorts of original documents. The resultant copy is called "the multi-coloured copy" in this specification. Since the reproduction of such a multi-coloured. copy can be easily conceived from the above-described operation, no further detailed explation is made.

While the invention has been described in terms of certain preferred embodiments, and examplified with respect thereto, those skilled in the art will readily appreciate that various modifications, changes, omissions, and substitutions may be made without departing from the spirit of the invention.

In the above-described embodiments, two colour developers were employed. It is obvious to employ more colour developers than two. In this case, the segment indicating the selected developer is turned on and the segments indicating the remaining developers flicker, and further the segment indicating the depletion of the toner particles of the selected developer is turned on, or flickers.

It is possible to employ other colour toner particles than the red and black toner particles.

A light emitting diode or an incandescent lamp may be employed instead of the liquid crystal diode.

Another way of selecting colour may be introduced by turning off the specific coloured segment, for example, the black-coloured segment.

What is claimed is:

1. An apparatus for producing a monochromatic reproduction comprising:

a photosensitive drum;

means for forming latent image on said photosensitive drum;

means for alternately selecting a first and a second color;

developing means, including means for storing a supply of said toner of said first color and means for storing a supply of toner of said second color, said developing means operatively coupled to said selecting means, said developing means for supplying first color toner to said photosensitive drum if said selecting means selects said first color and for supplying second color toner to said photosensitive drum if said selecting means selected said second color toner, said supply of first or second color toner devloping said latent image;

means, operatively connected to said selecting means, for visually indicating which of said first and second colors is selected by said selecting means;

first depletion sensing means for producing a first signal if said supply of first color toner stored by said first color toner storing means is depleted;

second depletion sensing means for producing a second signal if said supply of second color toner stored by said second color toner storing means is depleted;

means for visually indicating said supply of first color toner is depleted in response to said first signal and for visually indicating said supply of second color toner is depleted in response to said second signal; and means for transferring an image developed by said developing means from said drum to a medium.

2. An apparatus for producing a monochromatic reproduction comprising:

a photosensitive drum;

means for forming a latent image on said photosensitive drum;

means for alternately selecting a first and a second color;

first developing means, including means for storing a supply of toner of said first color, for developing a latent image on said photosensitive drum with said first color toner when in operative contact with said photosensitive drum;

second developing drum means, including means for storing a supply of toner of said second color, for developing a latent image on said photosensitive drum with said second color toner when in operative contact with said photosensitive drum;

means for mechanically moving said first developing means into operative contact with said photosensitive drum and mechanically moving said second developing means out of operative contact with said photosensitive drum when said selecting means selects said first color, and for mechanically moving said second developing means into operative contact with said drum and mechanically moving said first developing means out operative contact with said drum when said selecting means selects said second color;

means for visually indicating which of said first and second color is selected by said selecting means;

first depletion sensing means for producing a first signal if said supply of first color toner stored by said first color toner storing means is depleted;

second toner depletion sensing means for producing a second signal if the supply of toner stored by said second color toner supplying means is depleted;

means for visually indicating said supply of first color toner is depleted in response to said first signal and for visually indicating said supply of second color toner is depleted in response to said second signal; and means for transferring an image developed by said first or second developing means from said photosensitive drum to a medium.

3. An apparatus as in claim 2 further including initialization control means for:

automatically causing said selecting means to select said first color;

automatically causing said moving means to mechanically move said first developing means into operative contact with said drum and mechanically move said second developing means out of operative contact with said drum; and causing said selection visual indicating means to indicate said first color is selected.

4. An apparatus as in claim 2 wherein said selection visual indicating means comprises:

means for selectively illuminating a first pictorial diagram of a receptacle filled with particles of said selected color; and means for selectively darkening a further pictorial diagram of a receptacle filled with particles of the one of said first and second colors not selected by said selecting means.

5. An apparatus as in claim 4 wherein said toner depletion visual indicating means comprises means for flickering the illumination of at least a part of the pictorial diagram illuminated by said illuminating means in response to said first and/or second signals.

6. A method for producing a monochromatic reproduction comprising the steps of:

(1) selecting only one of a first and a second color;

(2) visually indicating which of said first and second colors is selected by said selecting step (1);

(3) if said first color is selected by said selecting step (1), performing the following steps:

(a) producing a first signal if a supply of toner of said first color is depleted, and (b) visually indicating said supply of first color toner is depleted in response to said first signal;

(4) if said second color is selected by said selecting step (1), performing the following steps:

(a) producing a second signal if a supply of toner of said second color is depleted, and (b) visually indicating said supply of second color toner is depleted in response to said second signals;

(5) producing a latent image on said photosensitive drum;

(6) developing said latent image with toner of said first color if said first color is selected by said selecting step (1);

(7) developing said latent image with said second color toner if said second color is selected by said selecting step (1); and (8) transferring said developed image to a medium.

7. A method for producing a monochromatic reproduction comprising the steps of:

(1) selecting only one of a first and a second color;

(2) if said first color is selected by said selecting step (1), mechanically moving a first developing means for supplying toner of said first color into operative contact with a photosensitve drum and mechanically moving a second developing means for supplying toner of said second color out of operative contact with said photosensitive drum;

(3) if said second color is selected, mechanically moving said second developing means into operative contact with said drum and mechanically moving said first developing means out of operative contact with said drum;

(4) visually indicating which of said first and second colors is selected by said selected step (1);

(5) if said first color is selected by said selecting step (1), performing the following steps:

(a) producing a first signal if a supply of toner of said first color stored by said first developing means is depleted, and (b) visually indicating said supply of first color toner is depleted in response to said first signal;

(6) if said second color is selected by said selecting step (1), performing the following steps:

(a) producing a second signal if a supply of toner of said second color stored by said second developing means is depleted, and (b) visually indicating said supply of second color toner is depleted in response to said second signal;

(7) producing a latent image on said photosensitive drum;

(8) developing said latent image with the one of said drum; first and second developing means in operative contact with said drum; and (9) transferring said developed image to a medium.

8. A method as in claim 7 further including the preliminary step of:

automatically selecting said first color;

automatically mechanically moving said first developing means into operative contact with said drum and mechanically moving said second developing means out of operative contact with said drum; and automatically visually indicating said first color is selected.

9. A method as in claim 7 wherein said visually indicating step (4) comprises the steps of:

illuminating a first pictorial diagram of a receptacle filled with particles of said selected color; and darkening a second pictorial diagram of a recptacle filled with particles of the one of said first and second colors not selected.

10. a method as in claim 9 wherein said visually indicating steps (5*b*) and (6*b*) comprises a step of flickering the illumination of at least a part of the pictorial diagram illuminated by said indicating step (4).

* * * * *